US009053661B2

(12) United States Patent
Lee et al.

(10) Patent No.: US 9,053,661 B2
(45) Date of Patent: Jun. 9, 2015

(54) DISPLAY DEVICE AND DRIVING METHOD THEREOF

(75) Inventors: Chang-Soo Lee, Cheonan-si (KR); Jong Jae Lee, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 1036 days.

(21) Appl. No.: 13/102,076

(22) Filed: May 6, 2011

(65) Prior Publication Data

US 2012/0092314 A1 Apr. 19, 2012

(30) Foreign Application Priority Data

Oct. 14, 2010 (KR) ..... 10-2010-0100347

(51) Int. Cl.

| | |
|---|---|
| ***G09G 5/00*** | (2006.01) |
| ***G09G 3/20*** | (2006.01) |
| *G09G 3/32* | (2006.01) |
| *G09G 3/36* | (2006.01) |

(52) U.S. Cl.

CPC ..... *G09G 3/20* (2013.01); *G09G 3/3266* (2013.01); *G09G 3/3677* (2013.01); *G09G 2310/0267* (2013.01)

(58) Field of Classification Search

CPC ..... G09G 2310/0267; G09G 3/3696; G09G 3/3266; G09G 2310/0283

USPC ..... 345/87, 95, 204, 206, 210, 214, 64, 98, 345/94, 99, 100, 101, 103

See application file for complete search history.

(56) References Cited

U.S. PATENT DOCUMENTS

| | | | | |
|---|---|---|---|---|
| 2008/0079701 | A1* | 4/2008 | Shin et al. | 345/204 |
| 2008/0129717 | A1* | 6/2008 | Lee et al. | 345/204 |
| 2010/0039364 | A1* | 2/2010 | Lee | 345/100 |

* cited by examiner

*Primary Examiner* — William Boddie
*Assistant Examiner* — Saifeldin Elnafia
(74) *Attorney, Agent, or Firm* — F. Chau & Associates, LLC

(57) ABSTRACT

A gate-off voltage generator provides a gate-off voltage to a gate line of a display panel. The gate-off voltage generator includes a transistor having a base terminal, a collector terminal, and an emitter terminal, the emitter terminal configured to output the gate-off voltage to the gate line. A controller is connected to the base terminal. A feedback circuit is connected between the gate line and the controller, the feedback circuit configured to provide to the controller a feedback voltage based upon the gate-off voltage outputted from the emitter terminal. The gate-off voltage from the emitter terminal is compared with a desired gate-off voltage in the controller and the voltage at the base terminal is controlled by the controller to provide the desired gate-off voltage to gate line.

8 Claims, 3 Drawing Sheets

DISPLAY DEVICE AND DRIVING METHOD THEREOF

CROSS-REFERENCE TO RELATED APPLICATION

This application claims priority to and the benefit of Korean Patent Application No. 10-2010-0100347 filed in the Korean Intellectual Property Office on Oct. 14, 2010, the entire contents of which are incorporated by reference herein.

BACKGROUND OF THE INVENTION (a) Technical Field

The present disclosure relates to a display device and a driving method thereof.

(b) Discussion of Related Art

Liquid crystal display panels are one type of flat panel displays that are being used widely, and typically include two display panels that have a field generating electrode, such as a pixel electrode, a common electrode, and a liquid crystal layer interposed therebetween. The liquid crystal display supplies voltage to the field generating electrode, and then forms an electric field on the liquid crystal layer, thereby determining the direction of liquid crystal molecules on the liquid crystal layer and displaying an image by controlling the polarization of incident light. In addition to the liquid crystal display, the flat panel display panel include an organic light emitting diode (OLED) display, a plasma display panel (PDP), an electrophoretic display device, and the like.

The display device typically includes a display panel having pixels that include switching elements and display signal lines such as gate lines and data lines, a gate driver that turns on/off the switching element of the pixel by transmitting gate signals to the gate lines, a data driver that supplies data voltage to the data lines, a signal controller that controls the gate driver and the data driver.

The gate signal that is supplied to the gate line by the gate driver which is configured such that a gate-on voltage Von turns on the switching element of the pixel and a gate-off voltage Voff turns off the switching element of the pixel.

The gate driver and the data driver may be mounted in the display device in a type of IC chip, attached on the display device in a type of tape carrier package (TCP) by being mounted on a flexible printed circuit film, or mounted on a printed circuit board. Particularly, the gate driver may be integrated in the display panel by the same process that is used for the display signal line, the switching element, and the like.

When integrating the gate driver in the display panel, a lower voltage than the gate-off voltage Voff is needed to supply the gate-off voltage Voff to the gate line. Hereinafter, such voltage lower than the gate-off voltage Voff is called a second gate-off voltage Voffe.

However, the gate-off voltage Voff may be unstable as a result of the interconnection of the gate-off voltage Voff and the second gate-off voltage Voffe. A change of the gate-off voltage Voff may be further intensified when the display panel becomes larger or the display device is driven at a low temperature.

SUMMARY OF THE INVENTION

The present invention has been made in an effort to provide a display device that stably supplies a gate-off voltage and a driving method thereof.

According to an exemplary embodiment of the present invention, a display device includes a substrate, a gate line formed on the substrate, and a gate-off voltage generator that generates a gate-off voltage supplied to the gate line. The gate-off voltage generator includes a transistor having a base terminal, a collector terminal and an emitter terminal that outputs the gate-off voltage to the gate line. A controller is connected to the base terminal and is fedback with a feedback voltage according to the gate-off voltage outputted by the emitter terminal.

The gate line may include a first end supplied with the gate-off voltage and a second end supplied with a second gate-off voltage. The gate-off voltage generator may further include a resistor between the emitter terminal and the terminal supplied with the second gate-off voltage, and the second gate-off voltage may be lower than the gate-off voltage.

The gate line may include a first end supplied with the gate-off voltage and a second end supplied with a second gate-off voltage.

The gate-off voltage generator may further include a resistor between the emitter terminal and the terminal supplied with the second gate-off voltage, and the second gate-off voltage may be lower than the gate-off voltage.

The controller may control the base voltage supplied to the base terminal based upon the feedback voltage.

The controller may be configured to: detect the gate-off voltage based upon the feedback voltage, compare the gate-off voltage with a first voltage, and when the gate-off voltage is different than the first voltage, control the base voltage such that the gate-off voltage becomes the first voltage.

The gate-off voltage generator may further include a discharge resistor between the emitter terminal and the ground.

The gate-off voltage generator may further include a first resistor and a second resistor connected in series between the emitter terminal and the terminal supplied with the reference voltage, and the feedback voltage may be a voltage at a node between the first resistor and the second resistor.

The controller may control the base voltage supplied to the base terminal based upon the feedback voltage.

The controller may be configured to: detect the gate-off voltage based upon the feedback voltage, compare the gate-off voltage with a first voltage, and when the gate-off voltage is different than the first voltage, control the base voltage such that the gate-off voltage becomes the first voltage.

The gate-off voltage generator may further include a discharge resistor between the emitter terminal and the ground.

According to an exemplary embodiment of the present invention, a driving method of a display device having a substrate, a gate line formed on the substrate, and a gate-off voltage generator that generates a gate-off voltage supplied to the gate line, is provided. The gate-off voltage generator includes a transistor having a base terminal, a collector terminal and an emitter terminal that outputs the gate-off voltage by connecting to the gate line, and a controller connected to the base terminal. The method includes feeding back a feedback voltage according to the gate-off voltage outputted to the emitter terminal from the gate-off voltage generator to the controller, detecting the gate-off voltage based upon the feedback voltage in the controller, comparing the gate-off voltage with a first voltage in the controller and controlling the base voltage such that the gate-off voltage becomes the first voltage when the gate-off voltage is different from the first voltage in the controller.

The gate-off voltage generator may be formed on the substrate.

According to an exemplary embodiment of the present invention, a gate-off voltage generator for providing a gate-off voltage to a gate line of a display panel includes a transistor having a base terminal, a collector terminal, and an emitter terminal, the emitter terminal configured to output the gate-off voltage to the gate line, a controller connected to the base terminal, and a feedback circuit connected between the gate line and the controller, the feedback circuit configured to provide to the controller a feedback voltage based upon the gate-off voltage outputted from the emitter terminal. The gate-off voltage from the emitter terminal is compared with a desired gate-off voltage in the controller and a voltage at the base terminal is controlled by the controller to provide the desired gate-off voltage to gate line.

According to the exemplary embodiments of the present invention, a display device that stably supplies the gate-off voltage and a driving method thereof are provided.

DETAILED DESCRIPTION OF THE EMBODIMENTS

Figure 1:
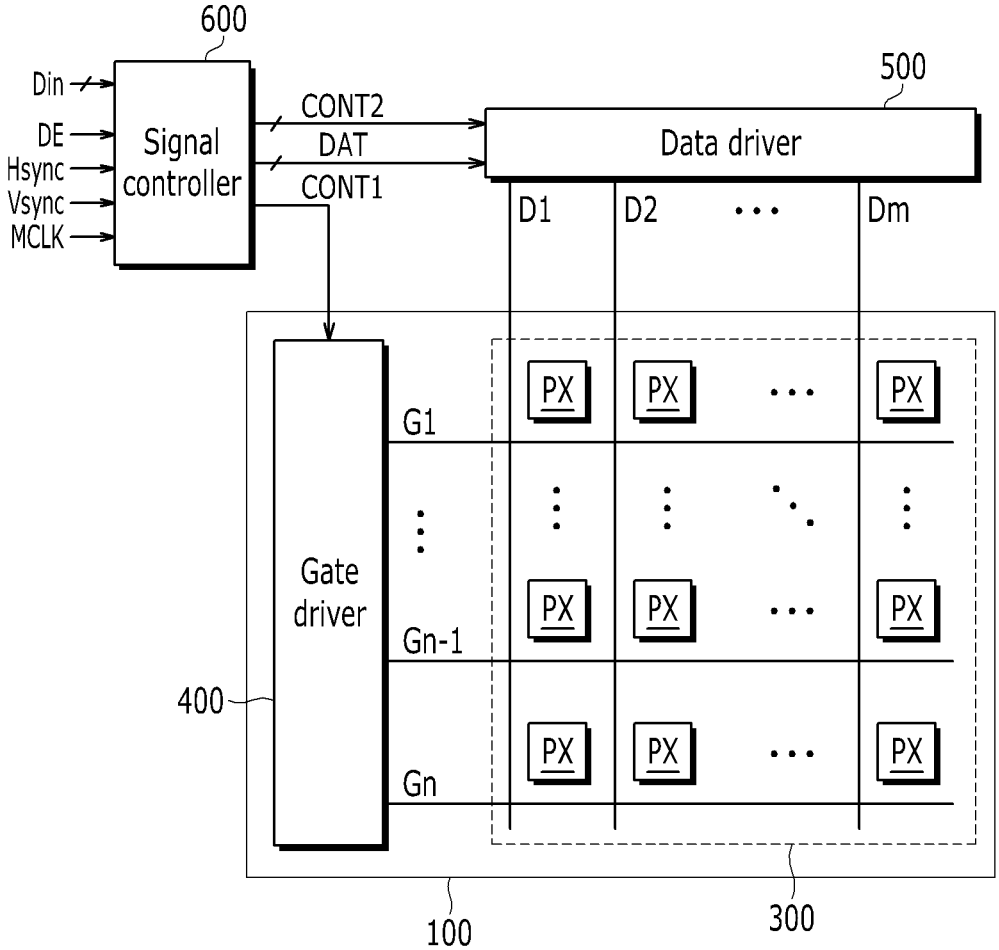
FIG. 1 is a block diagram of a display device according to an exemplary embodiment of the present invention.

The present invention will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In the drawings, like reference numerals designate like elements throughout the specification. It will be understood that when an element such as a region or substrate is referred to as being "on" another element, it can be directly on the other element or intervening elements may also be present. In contrast, when an element is referred to as being "directly on" another element, there are no intervening elements present.

Referring now to FIG. 1, a display device according to an exemplary embodiment of the present invention includes a thin film transistor display panel 100, a gate driver 400, a data driver 500 and a signal controller 600. The thin film transistor display panel 100 includes on a substrate a display area 300 that displays an image and the gate driver 400.

The display area 300 of the thin film transistor display panel 100 includes a plurality of signal lines G1-Gn, D1-Dm on the substrate, and a plurality of pixels PX on the substrate. The pixels PX are connected to the signal lines and are roughly arranged in a matrix type equivalent circuit.

The signal lines G1-Gn, D1-Dm include a plurality of gate lines G1-Gn that transfer a gate signal (also called as "a scanning signal") and data lines D1-Dm that transfer a data signal.

Each pixel PX includes a switching element (not shown) that is connected to the signal lines G1-Gn, D1-Dm.

The gate driver 400 supplies a gate signal that is composed of the combination of the gate-on voltage Von and the gate-off voltage Voff to the gate lines G1-Gn by connecting to the gate lines G1-Gn. The gate driver 400 is substantially a shift register having a plurality of stages each connected to the gate lines G1-Gn, respectively, and may be formed by using the same process used for the switching element of pixel PX to be integrated on the edge of the thin film transistor display panel 100.

The data driver 500 is connected to data lines D1-Dm of the thin film transistor display panel 100, and supplies data signals to the data lines D1-Dm.

The signal controller 600 controls the gate driver 400 and the data driver 500.

The data driver 500 and signal controller 600 may be directly mounted on the thin film transistor display panel 100 in a type of at least one IC chip, attached on the thin film transistor display panel 100 in a type of a tape carrier package (TCP) by being mounted on the flexible printed circuit film (not shown), or may be mounted on a separate printed circuit board (PCB) (not shown). Alternatively, the data driver 500 and signal controller 600 may be integrated on the thin film transistor display panel 100 together with the signal lines G1-Gn, D1-Dm and the switching elements, as with the gate driver 400.

The operation of the display device will now be described in more detail.

The signal controller 600 receives an input image signal Din and an input control signal that controls the display of the input image signal Din from an external graphic controller (not shown). Examples of the input control signal include a vertical synchronization signal Vsync and a horizontal synchronizing signal Hsync, a main clock MCLK, and a data enable signal DE.

The signal controller 600 processes the input image signal Din in accordance with the operating conditions of the thin film transistor display panel 100 based upon the input control signal and the input image signal Din, generates a gate control signal CONT1, a data control signal CONT2, and then transfers to the gate driver 400 the gate control signal CONT1 and transfers to the data driver 500 the processed image signal DAT together with the data control signal CONT2.

The gate control signal CONT1 includes a scanning start signal STV that instructs a scanning start and at least one clock signal that controls an output period of the gate-on voltage Von. Also, the gate control signal CONT1 may further include an output enable signal OE that limits the running time of the gate-on voltage Von.

The data control signal CONT2 includes the horizontal synchronization start signal STH that provides a transmitting start of the image data to one row of the pixels PX, a load signal LOAD that instructs to the data signal to be supplied to the data lines D1-Dm, and a data clock signal HCLK. Also, the data control signal CONT2 may further include an inversion signal RVS that reverses the voltage polarity of the data signal relative to the common voltage Vcom (hereinafter, called the "polarity of the data signal").

According to the data control signal CONT2 from the signal controller 600, the data driver 500 receives the digital image signal DAT for one row of pixels PX, selects a gray voltage corresponding to each digital image signal DAT, thereby converting the digital image signal DAT into an analog data signal, and then supplies the analog data signal to the corresponding data lines D1-Dm.

The gate driver 400 supplies the gate-on voltage Von to the gate lines G1-Gn according to the gate control signal CONT1 from the signal controller 600 to turn-on the switching element that is connected to the gate lines G1-Gn. And then, the data signal that is supplied to the data lines D1-Dm can be supplied to the corresponding pixel PX through the turned on switching element.

By repeating the process in one unit of 1 horizontal period (1H), and which is the same as one period of the horizontal synchronizing signal Hsync and data enable signal DE, the image of one frame is displayed by sequentially supplying the gate-on voltage Von to all the gate lines G1-Gn to supply the data signal to all the pixels PX.

After one frame is finished, the next frame is started, and then the state of the inversion signal RVS that is supplied to the data driver 500 is controlled so that the polarity of the data signal that is supplied to each pixel PX becomes the opposite of the polarity of a previous frame ("frame inversion"). With this configuration, the polarity of the data signal that flows through one data line may be changed according to the character of the inversion signal RVS (for example, row inversion, dot inversion), or the polarity of the data signal that is supplied to one pixel row may be different each other (for example, column inversion, dot inversion).

As described above, the gate driver 400 supplies the gate signal that is composed of the combination of the gate-on voltage Von and the gate-off voltage Voff to the gate lines G1-Gn by connecting to the gate lines G1-Gn.

Figure 2:
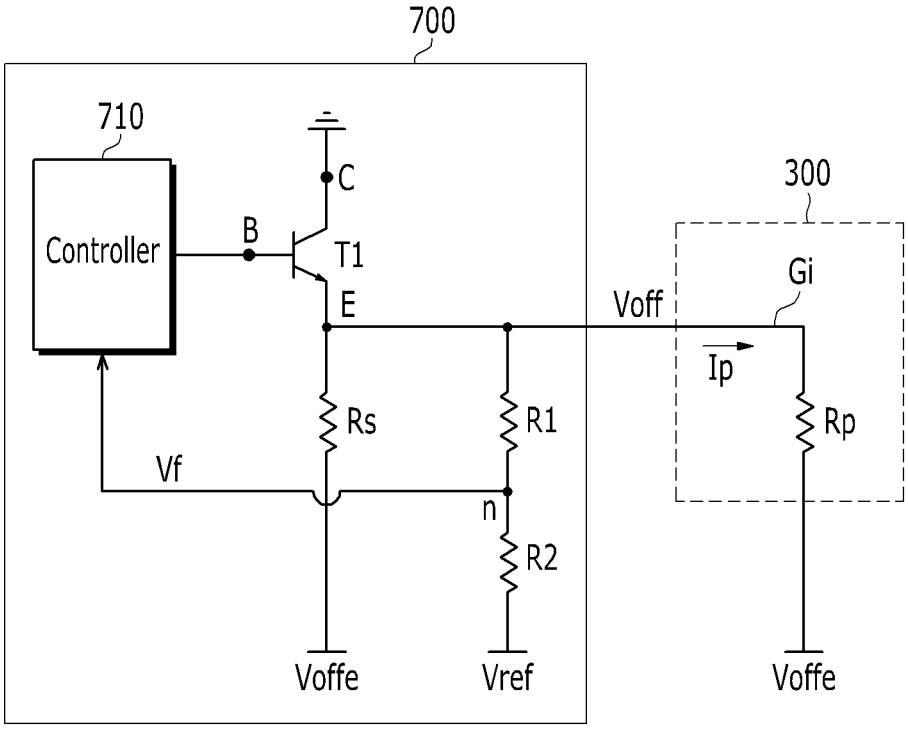
FIG. 2 is a block diagram of a gate-off voltage generator according to an exemplary embodiment of the present invention.

According to an exemplary embodiment, the gate driver 400 may include a gate-off voltage generator 700, as depicted in FIG. 2. The gate-off voltage generator 700 includes a controller 710, a transistor T1 and a plurality of resistors Rs, R1, and R2.

The transistor T1 may be a bipolar junction transistor BJT, and includes a base terminal B, a collector terminal C and an emitter terminal E. The base terminal B is connected to the controller 710 and the collector terminal C is connected to the ground. The emitter terminal E is connected to one end of the resistor Rs and one end of the first resistor R1. The second gate-off voltage Voffe is supplied to the other end of the resistor Rs.

The second gate-off voltage Voffe, which is a lower voltage than the gate-off voltage Voff, is needed for driving the display device when the gate driver is integrated in the display panel together with the signal line and the switching element. Hereinafter, the voltage that is needed as the gate-off voltage Voff for driving the display device will be called first voltage V1.

For example, the first voltage V1 is about −7V to −7.5V. When operating at a room temperature, the second gate-off voltage Voffe may be about −11V to −12V, and when operating at a low temperature, the second gate-off voltage Voffe may be about −20V.

The other end of the first resistor R1 is connected to one end of the second resistor R2, and a reference voltage Vref is supplied to the other end of the second resistor R2. That is, the first resistor R1 and the second resistor R2 are connected in series between the emitter terminal B and the terminal that is supplied with the reference voltage Vref. The voltage at node n, to which the first resistor R1 and the second resistor R2 are connected is feedback as a feedback voltage Vf to the controller 710.

The gate-off voltage Voff that is outputted through the emitter terminal E of the gate-off voltage generator 700 is supplied to the display area 300 through the gate line Gi. The gate line Gi is one of gate lines G1-Gn in FIG. 1. The gate line Gi includes a first end that is supplied with the gate-off voltage Voff, a second end that is supplied with the second gate-off voltage Voffe and a gate line resistor Rp between the first end and the second end. The gate line resistor Rp is the value, in which the gate line Gi has in general, and may have different values according to the structure and character of the display area 300.

The feedback voltage Vf that is fedback to the controller 710 can be represented by the following Equation 1:

$$Vf = \frac{R2Voff + R1Vref}{R1 + R2} \quad \text{(Equation 1)}$$

Referring to Equation 1, when fixing the first resistor R1, the second resistor R2 and reference voltage Vref, the feedback voltage Vf is changed according to the gate-off voltage Voff that is output from emitter terminal E.

The operation of the gate-off voltage generator 700 will now be described in more detail.

Current Ip flows by providing the gate-off voltage Voff and the second gate-off voltage Voffe in the gate line Gi of the display area 300. When the voltage that should be supplied to the gate-off voltage Voff in order to drive the display device is a first voltage V1, the gate-off voltage Voff may be changed to a lower voltage than that of the first voltage V1 due to the sharp increase of current Ip. The change of the gate-off voltage Voff becomes further intensified as the display device becomes larger. In addition, the change of the gate-off voltage Voff becomes larger when operating at a low temperature.

The controller 710 can detect the gate-off voltage Voff that is output from the emitter terminal E based upon the feedback voltage Vf. With this configuration, the gate-off voltage Voff can be detected by using Equation 1.

The controller 710 compares the gate-off voltage Voff with the first voltage V1. The controller 710 may see whether or not the gate-off voltage Voff is changed through the comparison of the detected gate-off voltage Voff and the first voltage V1.

The controller 710 controls the base voltage that is supplied to the base terminal B such that the gate-off voltage Voff that is the output voltage of the emitter terminal E is the first voltage V1 when the gate-off voltage Voff becomes different than the desired first voltage V1. The gate-off voltage Voff is returned to the first voltage V1 through the control of the base voltage.

Figure 3:
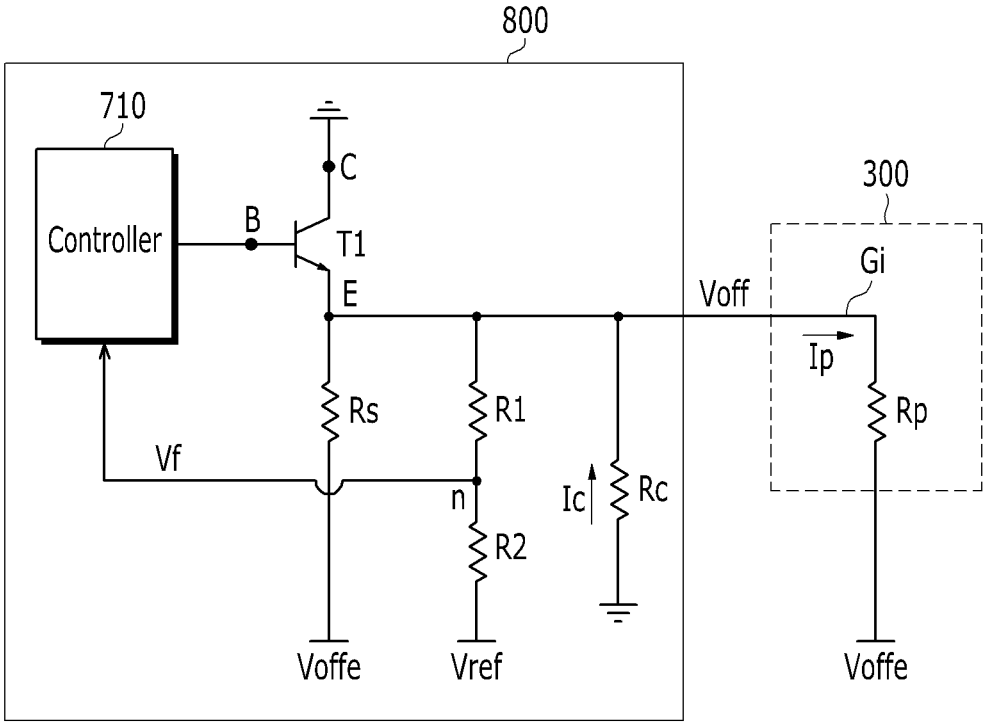
FIG. 3 is a block diagram of a gate-off voltage controller according to another exemplary embodiment of the present invention.

FIG. 3 is a block diagram of a gate-off voltage controller according to an exemplary embodiment of the present invention.

Referring to FIG. 3, the gate-off voltage generator 800 includes a controller 710, a transistor T1, a plurality of resistors Rs, R1, and R2 and a discharge resistor Rc. The gate-off voltage generator 800 in FIG. 3 has substantially the same structure as the gate-off voltage generator 700 in FIG. 2. However, the gate-off voltage generator 800 further includes the discharge resistor Rc between the ground and the emitter terminal E of the transistor T1.

The gate-off voltage Voff is negative voltage, so that current Ic flows from the ground to the emitter terminal E through the discharge resistor Rc. When current Ip that flows to the gate line Gi is sharply increased, the gate-off voltage Voff is decreased rather than the first voltage V1 to be maintained. However, with this configuration, current Ic that flows through the discharge resistor Rc compensates current Ip that flows to the gate line Gi, so that the degree of change of the gate-off voltage Voff may be relieved.

That is, the gate-off voltage generator 800 may maintain the gate-off voltage Voff as the first voltage V1 through the discharge resistor Rc and the controller 710 that controls the base voltage that is inputted to the base terminal B.

The resistor Rp and the resistor Rs are connected in parallel. The discharge resistor Rc is connected in parallel to the resistors Rp, Rs. With this configuration, the discharge resistor Rc may be predetermined to satisfy the following Equation 2:

$$Voff = \frac{Rc}{(Rp // Rs) + Rc} Voffe < V1 \quad \text{(Equation 2)}$$

Referring to Equation 2, the gate-off voltage generator 800 uses the discharge resistor Rc that makes the gate-off voltage Voff to be lower than the first voltage V1. When the discharge resistor Rc is predetermined to make the gate-off voltage Voff to be higher than the first voltage V1, the gate-off voltage Voff cannot obtain the first voltage V1 that is the desired real voltage because lower voltage than the predetermined voltage cannot be generated.

As described above, the display device that can stably supply the gate-off voltage Voff and the driving method thereof can be provided according to the exemplary embodiment of the present invention. The gate driver can generate the gate-off voltage Voff that is not changed, so that stable display characteristics of the display device can be secured. The gate-off voltage generator for stably supplying the gate-off voltage Voff does not need a circuit element, such as a charge pump, or a zener diode, and can simply implement the stable supply of the gate off voltage Voff through the transistor. Thus, cost reduction and competitiveness in a market can be secured.

In addition, when operating at both room temperature and at a low temperature, the stable gate-off voltage Voff can be all maintained through the feedback, and even when the gate-off voltage Voff is changed, it can be controlled to stably maintain the gate-off voltage Voff.

While the present invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A display device comprising:

a substrate;

a gate line formed on the substrate; and a gate-off voltage generator that generates a gate-off voltage supplied to the gate line, wherein the gate-off voltage generator comprises:

a transistor having a base terminal, a collector terminal connected to ground, and an emitter terminal connected to the gate line, wherein the emitter terminal outputs the gate-off voltage to the gate line;

a first resistor and a second resistor connected in series between the emitter terminal and a terminal supplied with a reference voltage fixed and different from ground;

a discharge resistor between the emitter terminal and the ground; and a controller connected to the base terminal and feedback with a feedback voltage which is a voltage of a node connected with the first resistor and the second resistor, wherein the gate line includes a first end supplied with the gate-off voltage and a second end supplied with a second gate-off voltage and wherein the second gate-off voltage is lower than the gate-off voltage.

2. The device of claim 1, wherein the gate-off voltage generator is formed on the substrate.

3. The device of claim 1, wherein the controller controls a base voltage supplied to the base terminal based upon the feedback voltage.

4. The device of claim 3, wherein the controller is configured to:

detect the gate-off voltage based upon the feedback voltage, compare the gate-off voltage with a first voltage, and when the gate-off voltage is different than the first voltage, control the base voltage such that the gate-off voltage becomes the first voltage.

5. The device of claim 1, wherein:

the gate-off voltage generator further comprises a resistor between the emitter terminal and a terminal supplied with the second gate-off voltage.

6. A driving method of a display device having a substrate, a gate line formed on the substrate, and a gate-off voltage generator that generates a gate-off voltage supplied to the gate line, wherein the gate-off voltage generator comprises a transistor having a base terminal, a collector terminal and an emitter terminal wherein the emitter terminal outputs the gate-off voltage by connecting to the gate line, a first resistor and a second resistor connected in series between the emitter terminal and the terminal supplied with a reference voltage fixed and different from ground, a discharge resistor between the emitter terminal and the ground, and a controller connected to the base terminal, the method comprising:

supplying a first end of the gate line with the gate-off voltage while supplying a second end of the gate line with a second gate-off voltage, wherein the second gate-off voltage is lower than the gate-off voltage, feeding back a feedback voltage which is a voltage of a node connected with the first resistor and the second resistor;

detecting the gate-off voltage based upon the feedback voltage in the controller;

comparing the gate-off voltage with a first voltage in the controller; and controlling the base voltage such that the gate-off voltage becomes the first voltage when the gate-off voltage is different from the first voltage in the controller.

7. The method of claim 6, wherein the gate-off voltage generator is formed on the substrate.

8. A gate-off voltage generator for providing a gate-off voltage to a gate line of a display panel, comprising:

a transistor having a base terminal, a collector terminal, and an emitter terminal connected to the gate line, the emitter terminal configured to output the gate-off voltage to a first end of the gate line, a controller connected to the base terminal;

a first resistor and a second resistor connected in series between the emitter terminal and a terminal supplied with a reference voltage fixed and different from ground;

a discharge resistor between the emitter terminal and the ground; and a feedback circuit connected between the gate line and the controller, the feedback circuit configured to provide to the controller a feedback voltage which is a voltage of a node connected with the first resistor and the second resistor, based upon the gate-off voltage outputted from the emitter terminal, wherein a second end of the gate line is supplied with a second gate-off voltage, wherein the gate-off voltage from the emitter terminal is compared with a desired gate-off voltage in the controller and a voltage at the base terminal is controlled by the controller to provide the desired gate-off voltage to gate line, wherein the second gate-off voltage is lower than the gate-off voltage.

* * * * *